US011546703B2

(12) United States Patent
Nagel et al.

(10) Patent No.: US 11,546,703 B2
(45) Date of Patent: Jan. 3, 2023

(54) METHODS FOR OBTAINING AND REPRODUCING A BINAURAL RECORDING

(71) Applicant: Rheinisch-Westfälische Technische Hochschule (RWTH) Aachen, Aachen (DE)

(72) Inventors: Sebastian Nagel, Aachen (DE); Peter Jax, Aachen (DE)

(73) Assignee: RHEINISCH-WESTFÄLISCHE TECHNISCHE HOCHSCHULE (RWTH) AACHEN, Aachen (DE)

( * ) Notice: Subject to any disclaimer, the term of this patent is extended or adjusted under 35 U.S.C. 154(b) by 0 days.

(21) Appl. No.: 17/268,554

(22) PCT Filed: Aug. 2, 2019

(86) PCT No.: PCT/EP2019/070949
§ 371 (c)(1),
(2) Date: Feb. 15, 2021

(87) PCT Pub. No.: WO2020/035335
PCT Pub. Date: Feb. 20, 2020

(65) Prior Publication Data

US 2021/0314710 A1 Oct. 7, 2021

(30) Foreign Application Priority Data

Aug. 16, 2018 (DE) ..... 10 2018 006 450.7
Sep. 12, 2018 (DE) ..... 10 2018 007 201.1
Mar. 21, 2019 (DE) ..... 10 2019 107 302.2

(51) Int. Cl.
*H04R 25/00* (2006.01)
*H04S 1/00* (2006.01)
*H04S 7/00* (2006.01)

(52) U.S. Cl.
CPC ..... *H04R 25/552* (2013.01); *H04S 1/005* (2013.01); *H04S 1/007* (2013.01); *H04S 7/304* (2013.01);
(Continued)

(58) Field of Classification Search
CPC ..... H04S 1/005; H04S 2420/01; H04R 2205/041
(Continued)

(56) References Cited

U.S. PATENT DOCUMENTS 7,333,622 B2 2/2008 Algazi et al.
9,848,273 B1 12/2017 Helwani et al.
2018/0210695 A1 7/2018 Tsingos et al.

FOREIGN PATENT DOCUMENTS

WO WO 2016/074734 5/2016
WO WO-2016074734 * 5/2016 ..... H04S 7/00
(Continued)

OTHER PUBLICATIONS

PCT International Search Report and Written Opinion for corresponding PCT Application No. PCT/EP2019/070949, dated Oct. 23, 2019, 8 pages.

*Primary Examiner* — Yosef K Laekemariam
(74) *Attorney, Agent, or Firm* — Dority & Manning, P.A.

(57) ABSTRACT

In one aspect, a method for providing a binaural recording to a listener with a head applied in a hearing system, whereas the binaural recording is listened to using a hearing device and whereas the binaural recording consists of a left binaural ear signal intended for a left ear of the listener, and a right binaural ear signal intended for a right ear of the listener, comprises determining a head orientation, determining a source direction of the binaural recording with respect to the head orientation, detecting a change of the head orientation to a new head orientation, adapting the binaural recording
(Continued)

Figure 1:
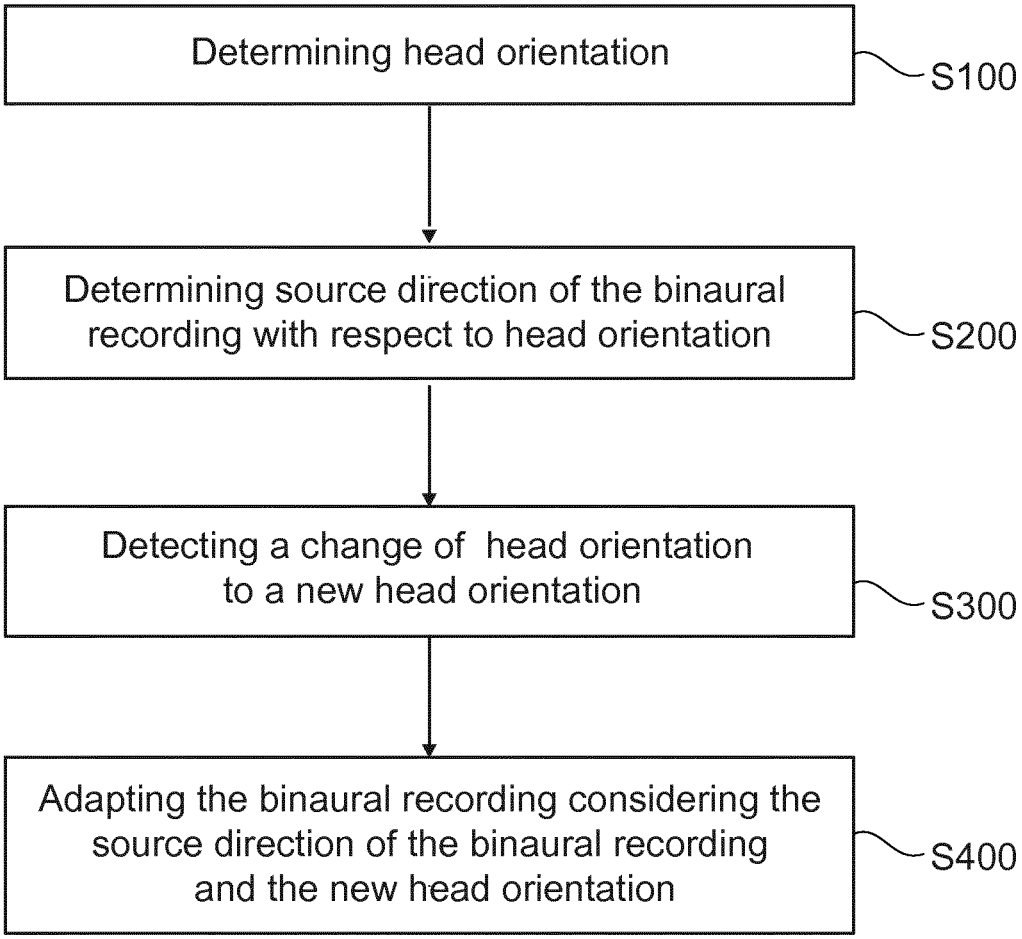

considering the source direction of the binaural recording and the new head orientation.

13 Claims, 3 Drawing Sheets

(52) U.S. Cl.
CPC ..... *H04R 2205/041* (2013.01); *H04S 2400/11* (2013.01); *H04S 2400/15* (2013.01); *H04S 2420/01* (2013.01)

(58) Field of Classification Search
USPC ..... 381/23.1, 74, 312, 367, 370, 376
See application file for complete search history.

(56) References Cited

FOREIGN PATENT DOCUMENTS

| | | | | |
|---|---|---|---|---|
| WO | WO 2018/041359 | | 3/2018 | |
| WO | WO-2018041359 | * | 3/2018 | ..... H04S 7/00 |

* cited by examiner

METHODS FOR OBTAINING AND REPRODUCING A BINAURAL RECORDING

This application is a national phase application of International Application No. PCT/EP2019/070949 filed on Aug. 2, 2019, which, in turn, is based upon and claims the right of priority to DE Patent Application No. 102018006450.7 filed on Aug. 16, 2018, DE Patent Application No. 102018007201.1 filed on Sep. 12, 2018, and DE Patent Application No. 102019107302.2 filed on Mar. 21, 2019, the disclosures of all of which are hereby incorporated by reference herein in their entirety for all purposes.

Human listeners are adept in identifying the location or origin of a detected sound in direction and distance. To this end humans estimate the location of a source by taking cues derived from one ear (monaural cues), and by comparing cues received at both ears (difference cues or binaural cues). These cues include time- and level-differences between both ears, spectral information, timing analysis, correlation analysis, and pattern matching.

A head-related transfer function (HRTF) is a response that characterizes how an ear receives a sound from a point in space. As sound strikes the listener, the size and shape of the head, ears, ear canal, density of the head all transform the sound and affect how it is perceived, boosting some frequencies and attenuating others. The HRTFs can vary significantly from person to person. A pair of HRTFs for two ears can be used to synthesize a binaural sound that seems to come from a particular point in space. Hence, for a listener, who listens to the binaural recording with headphones, a 3-D stereo sound sensation is generated, whereas the listener perceives the sound as if he or she is actually in the room with the sound source.

Binaural recordings made with artificial heads or in-ear microphones and played back with headphones is a well-established technique to capture and recreate many of the spatial cues perceived by humans in an acoustic scene. However, with normal headphone listening, signals do not change with head movements, so that sound sources in the acoustic scene seem to rotate with the listener's head, diminishing the listening experience. This has the effects, that the listener encounters problems localizing the sound source and perceives the sound source as being inside the head.

When using two loudspeakers for playback of the binaural recording the signal of one speaker is also heard by the contralateral ear (crosstalk), diminishing the desired effect of the binaural recording. Therefore, crosstalk cancellation filters are applied to lessen this effect and establish a realistic sound sensation. In principal, crosstalk cancellation methods take a part of the signal for the left speaker and feed it to the signal for the right speaker to have it combine with the signal of the right speaker such that it cancels the part of the signal that is heard by the left ear and viceversa. However, similar to headphone listening, the signals do not change with the listener's head movements, which leads to comparable detrimental effects considering the listening experience.

Furthermore, if the binaural recordings was made with in-ear microphones, the movement of the head of the recordist while recording is interwoven in the binaural recording. Hence, the listener of such a binaural recording encounters problems localizing the sound source, since it is perceived as not being static.

U.S. Pat. No. 9,848,273 B1 describes a hearing system including one or more hearing devices configured to be worn by a user. Each hearing device includes a signal source that provides an input electrical signal representing a sound of a virtual source. A filter implements a head related transfer function (HRTF) to add spatialization cues associated with a virtual location of the virtual source to the electrical signal and outputs a filtered electrical signal that includes the spatialization cues.

U.S. Pat. No. 7,333,622 B2 describes a different approach to capturing and reproducing either live or recorded three-dimensional sound. The method employs several microphones, a head tracker, and special signal-processing procedures to combine the signals picked up by the microphones.

It is an object of the present invention to create a more realistic and improved listening experience of a listener to a binaural recording. Particularly, it is an object of the present invention to overcome shortcomings of the prior art as limited source localization and lack of externalization, i.e. the perception of sources inside the head of the listener.

This object is achieved by the independent claims. Advantageous embodiments are given in the dependent claims.

In particular, the present invention provides a method for providing a binaural recording to a listener with a head applied in a hearing system, whereas the binaural recording is listened to using a hearing device and whereas the binaural recording consists of a left binaural ear signal intended for a left ear of the listener, and a right binaural ear signal intended for a right ear of the listener, comprising the method steps of determining a head orientation, determining a source direction of the binaural recording with respect to the head orientation, detecting a change of the head orientation to a new head orientation, and adapting the binaural recording considering the source direction of the binaural recording and the new head orientation. In short, the method determines the orientation and changes in orientation of the listener's head and adapts the binaural recording accordingly.

The present invention also provides a method for recording a binaural recording applied in a hearing system, whereas the binaural recording is recorded using a recording device carried on a head of a recordist, and whereas the binaural recording consists of a left binaural ear signal received by the recording device near and/or at a left ear of the recordist, and a right binaural ear signal received by the recording device near and/or at a right ear of the recordist comprising the method steps of determining a head orientation, determining a source direction of the binaural recording with respect to the head orientation, detecting a change of the head orientation to a new head orientation, and adapting the binaural recording considering the source direction of the binaural recording and the new head orientation. In short, the method determines the orientation and changes in orientation of the recordist's head and adapts the binaural recording accordingly.

Furthermore, the present invention also provides a method for providing a binaural recording to a listener, whereas the binaural recording is recorded by the second aforementioned method and the binaural recording is provided to the listener by the first aforementioned method. In other words, the method is a combination of the above-mentioned methods.

The basic idea of the invention is to analyze the binaural recording to determine the source direction in the original scene. Then, the binaural recording is modified to account for the listener's and/or recordist's change in head orientation, considering the source direction.

This basic idea can be incorporated in the process of listening to a binaural recording, which leads to a more realistic and improved listening experience. For the listener the perceived source direction appears fixed with regard to the environment, even though the listener is moving his/her head while listening. Therefore, source localization, externalization and realism of binaural recordings are improved.

Furthermore the basic idea can be incorporated in the process of recording a binaural recording using a recording device that is carried on a head of a recordist. Alternatively a recording device can also be carried on a movable and/or rotatable dummy head. In this case, the method provides a way to remove the traces or concomitants of the movements and/or rotations of the head of the recordist. For the listener of such binaural recordings, the perceived source direction appears fixed with regard to the environment, even though the recordist was moving his/her head/dummy head while recording. This improves the listening experience. Furthermore the method paves the way for easier and less expensive binaural recording techniques.

It is also possible that the basic idea is incorporated in the process of recording a binaural recording as well as in the process of listening to the binaural recording, therefore combining both advantages. An improved and more realistic listening experience can be generated even though an easy and inexpensive recording technique is used.

The methods are computationally simple and can be applied in real-time. Since the methods adapt the binaural recording either at the point where it is being recorded and/or at the point where a listener is listening to the binaural recording, the methods do not give rise to special signal processing or storing technologies in between the recording process and the listening process. No special sound cards, data formats, software and/or computer platforms are necessary in between recording and listening. The binaural recording can be stored in a common stereo-format, e.g. MP3, on common electronic devices like smartphones or other storage medias as usb flash drives, memory cards or compact discs. Hence, it is also possible to share the binaural recordings via a website and/or a server. Furthermore, the methods do not require special recording techniques, involving microphone arrays with more than two microphones, that are used to sample the sound field during recording. Therefore, the methods are easy to apply and do not generate additional costs. The methods lead to an improved listening experience. A listening experience is a manner by which the listener perceives sound. It can involve determining the location of the sound source. The brain of the listener utilizes subtle differences in loudness, tone and timing between the two ears to allow localization of the sound source. A listening experience in a real environment, like listening to a concert in a music hall, is often more appreciated than listening to a recording of the concert on a hearing device like headphones or a stereo.

A listener according to the present invention can be any kind of person listening to sound, e.g. music, speech or noise.

A binaural recording is a recording of sound signals, that generates a realistic listening experience, when listening to the binaural recording. The realistic listening experience can include a localization of the sound source. The binaural recording, according to the present invention can be a recording of any kind of sound. For example it can be a recording of music like a concert, speech like an audiobook or a telephone conference, noise, or a combination of these, like the sound accompanying a movie.

The binaural recording consists of a left binaural ear signal and a right binaural ear signal. Binaural recordings can be listened to by hearing devices that are carried on the head of the listener. Thereby it is possible that the right ear and the left ear of the listener are provided with different sound signals, allowing the listener to perceive a realistic listening experience. Typical hearing devices that are carried on the head of the listener are headphones, earphones, in-ear or on-ear phones and the like. It is also possible that the hearing device is part of a headset e.g. for a telephone or part of a virtual reality headset. Furthermore binaural recordings can be listened to through loudspeakers using crosstalk cancellation filters. The crosstalk cancelling filters can be applied directly to the binaural recording. When listening to a binaural recording, the left binaural ear signal is the signal being fed to the left speaker and/or to the earphone near the left ear of the listener and therefore intended for the left ear of the listener. The right binaural ear signal is the signal fed to the right speaker and/or to the earphone near the right ear of the listener and therefore intended for the right ear of the listener.

Binaural recordings can be generated by different binaural recording techniques, e.g. using a dummy head, a jecklin disc and/or a pair of in-ear or on-ear microphones. According to the present invention, it is not necessary to use a special recording technique with more than two microphones. When recording a binaural recording, the left binaural ear signal is the signal received by the recording device near and/or at the left ear of the recordist or dummy head or from the left sided microphone of the jecklin disc. The right binaural ear signal is the signal received by the recording device near and/or at the right ear of the recordist or dummy head or from the right sided microphone of the jecklin disc.

A recordist according to the present invention can be any kind of person recording a binaural recording by means of a recording device carried on the head of the recordist. A recordist according to the present invention can also be a dummy head to which a recording device is attached, or a jecklin disc with two microphones. The dummy head or jecklin disc can be mounted on a tripod, stand or rotating device. The important feature is that the recording device on the recordist's head or on the dummy head/jecklin disc can be moved and/or rotated together with the head. In case of a dummy head or jecklin disc the rotation/movement can be achieved by displacing or rotating the dummy head or the jecklin disc, respectively.

Typical recording devices that are carried on the head of the recordist are in-ear or on-ear microphones. It is also possible that the recording device is part of a camera mounted on the dummy head and/or on the tripod to which the dummy head is mounted. Alternatively two microphones on each side of a jecklin disc can be used.

According to the present invention a head orientation is the orientation of the head of the listener while listening and/or the orientation of the head of the recordist, dummy head, or jecklin disc while recording. Orientation can refer to any axis of the head with respect to an external environment of the head or with respect to another frame of reference. Preferably the head orientation is the orientation of an axis perpendicular to an inter ear connection of the head. For a human head this axis corresponds to an axis of view. For a dummy head and for a jecklin disc the inter ear connection refers to the connection between the two microphones used for recording.

The source direction is the direction of the sound source. While recording a binaural recording the source direction in the environment corresponds to the source direction of the binaural recording. When listening to a binaural recording the source direction is the perceived direction of the sound. The source direction can be a direction of a single source, where only one source is emitting sound. It is also possible that the source direction is a combined direction of a multi-source scene, where several sources are emitting sound. In general, it is possible that the source is placed independently of the listener and/or recordist. Therefore, it can be behind the listener and/or recordist, next to the listener and/or recordist or in front of the listener and/or recordist.

Preferably the sound source is in front of the listener and/or recordist.

The methods comprise the step of determining a head orientation. This head orientation can be an orientation with respect to the external environment of the listener or recordist. However, the step of determining a head orientation can also be a definition of an internal reference frame of the head. Preferably an initial head orientation defines an origin. All further head orientations can be measured with respect to this orientation. Alternatively a mean value of different head orientations over a specific time interval can be used to define an origin.

In a further step of the methods a source direction of the binaural recording with respect to the head orientation is determined. In case of a listener the source direction is the perceived source direction. In case of a recordist the source orientation of the binaural recording corresponds to the source direction in the environment. The source direction of the binaural recording can be determined by analyzing the binaural recording. The determination of the source direction is independent of any knowledge about the environment of the recordist or of the environment of the listener. After this step, the source direction with respect to the head orientation is known.

The methods then detect a change of the head orientation to a new head orientation. In general, this can be a small change of orientation or it can be a large change. The change can be fast or slow. The change of head orientation can be in every direction. It is possible that the change is detected by measuring the head orientation after fixed periods of time intervals. After this step, the amount of change of the head orientation and the new head orientation with respect to the internal reference frame of the head are known. Alternatively or additionally the amount of change of the head orientation and the new head orientation with respect to a previous head orientation are known. It is also possible that after this step the amount of change of the head orientation and the new head orientation with respect to an external frame of reference are known.

In a further step the methods adapt the binaural recording, considering the source direction of the binaural recording and the new head orientation. This step has the effect that the binaural recording is modified, according to the movement of the head and the determined source direction.

In case the steps are implemented in the recording process the effects are as follows: If a recordist was moving his or her head while recording or if a dummy head carrying the recording device was moved while recording, this movement is reflected in the binaural recording. The last step of the method allows for accounting this movement in the binaural recording. By adapting the binaural recording the influence of the movement onto the binaural recording can be cancelled out. Therefore, a binaural recording is generated that sounds as if the recordist's head has not moved while recording.

In case the steps are implemented in the listening process the effects are as follows: When a listener moves his or her head, normally the sound moves along with the head, generating the impression that the sound is inside the head of the listener. The last step of the method allows for accounting the head movement and reflecting the movement in the binaural recording. By adapting the binaural recording the influence of the movement can be considered. Therefore, a binaural recording is generated that sounds as if the source direction was fixed in the environment of the listener and an enhanced listening experience is ensured.

According to a preferred embodiment of the invention, the step of detecting a change of the head orientation to a new head orientation comprises detecting a rotational movement of the head. The head of the listener or recordist can in principle be moved laterally or rotated. However, a rotation of the head has a greater impact on the binaural recording than a lateral movement of the head. Preferably, the rotation of the head is a rotation around an axis perpendicular to the ground. In other words, it is a rotation of the head that is comparable to the movement of the head when crossing a heavy travelled road, or when shaking the head in disagreement. Alternatively or additionally also a rotation around another axis can be considered, for example a nodding of the head.

According to a preferred embodiment of the invention, the step of determining a source direction of the binaural recording with respect to the head orientation, and the step of adapting the binaural recording considering the source direction of the binaural recording and the new head orientation, comprise consulting a mapping table relating the head orientation to a difference between the left binaural ear signal and the right binaural ear signal for a given source direction. The steps of determining the source direction of the binaural recording and adapting the binaural recording considering the source direction of the binaural recording and the new head orientation both involve consulting a mapping table. A mapping table according to the present invention can be a multidimensional table or an arrangement of data in a complex structure. The mapping table generates a link between the head orientation and the binaural recording. The binaural recording consists of a left binaural ear signal and a right binaural ear signal, which differ from each other. The manner in which the left and right binaural ear signal differ from each other depends on the orientation of the head with respect to the source direction. This information can be stored in the mapping table. The mapping table can provide information about the difference in amplitude or level, referred to as interaural level difference ( $\widehat{ILD}$), and/or a difference in phase, referred to as interaural phase difference ( $\widehat{IPD}$). Hence, the mapping table allows for the determination of the source direction with respect to the head orientation independently of any knowledge about the environment of the recordist or of the environment of the listener. It only involves the binaural recording and the mapping table.

To this end, according to a preferred embodiment of the invention the step of determining a source direction of the binaural recording with respect to the head orientation of the listener or recordist, comprises determining a difference between the left binaural ear signal and the right binaural ear signal and comparing this difference to the mapping table relating the head orientation to the difference between the left binaural ear signal and the right binaural ear signal for a given source direction. For determining the source direction, the method determines the difference between the left binaural ear signal and the right binaural ear signal. This can be an interaural level difference (ILD) of the binaural recording and/or an interaural phase difference (IPD) of the binaural recording. This difference can then be compared to the $\widehat{ILD}$ and/or $\widehat{IPD}$ in the mapping table. Thereby, a determination of the source direction can be achieved. Preferably this determination of the source direction involves a minimization approach, where the $\widehat{ILD}$ and/or $\widehat{IPD}$ in the mapping table are determined that best fit the ILD and/or IPD of the binaural recording. This allows for a fast and reliable determination of the source direction.

The step of adapting the binaural recording considering the source direction of the binaural recording and the new head orientation preferably involves consulting the mapping table. For this purpose, according to a preferred embodiment of the invention, the step of adapting the binaural recording considering the source direction of the binaural recording and the new head orientation, comprises determining the new head orientation with respect to the source direction of the binaural recording and comparing this value of head orientation to a mapping table relating the head orientation to the difference between the left binaural ear signal and the right binaural ear signal for a given source direction. For determining the manner of adaptation of the binaural recording to count for the movement of the head of the recordist or listener, the new head orientation with respect to the source direction of the binaural recording is determined. This value can then be compared to the mapping table, to determine the manner of adaptation of the binaural recording. The mapping table can contain the $\widehat{ILD}$ and/or $\widehat{IPD}$ for different head orientations, therefore containing the information how the binaural recording can be adapted to account for the head movement.

According to a preferred embodiment of the invention the mapping table relating the head orientation to the difference between the left binaural ear signal and the right binaural ear signal for a given source direction, relates the head orientation to the difference in amplitude and/or to the difference in phase between the left binaural ear signal and the right binaural ear signal for a range of frequencies of the right and left binaural ear signals and for a given source direction. Preferably the mapping table creates a link between the head orientation and the difference in amplitude ( $\widehat{ILD}$) and/or the difference in phase ( $\widehat{IPD}$) between the left binaural ear signal and the right binaural ear signal. Preferably the mapping table contains both information, the $\widehat{ILD}$ and the $\widehat{IPD}$, allowing for a better determination of the source direction and also for a better adaptation of the binaural recording. The $\widehat{ILD}$ and/or $\widehat{IPD}$ can be different for different frequencies of the binaural ear signal, therefore the mapping table contains the $\widehat{ILD}$ and/or $\widehat{IPD}$ for a range of frequencies, e.g. for a range from 10 Hz to 20 kHz, covering the acoustic range of most humans. The mapping table contains the $\widehat{ILD}$ and/or $\widehat{IPD}$ as a function of the head orientation for a given source direction. The source direction can be given with respect to an internal reference frame of the head of the listener or recordist. For example the mapping table can be for a source direction of 0 degrees, meaning that the source of sound coincides with the origin of the internal reference frame of the head. The values of the $\widehat{ILD}$ and/or $\widehat{IPD}$ in the mapping table are small for head orientations close to 0 degrees. For a head orientation of 0 degree the values of $\widehat{ILD}$ and/or $\widehat{IPD}$ are zero. This means, that in the step of adapting the binaural recording considering the new head orientation, the binaural recording is not modified at all, if the new head orientation is the same as the head orientation determined in the first step of the method. In other words, if the listener or recordist does not move his or her head the binaural recording is not modified.

According to a preferred embodiment of the invention the mapping table relating the head orientation to the difference between the left binaural ear signal and the right binaural ear signal for a given source direction is adaptable to the head of the listener or recordist and/or to the ears of the listener or recordist and/or to an environment of the listener or recordist. There are two steps in the method that involve consulting the mapping table. The information stored in the mapping table about the $\widehat{ILD}$ and $\widehat{IPD}$ are important for the determination of the source direction and for the adaptation of the binaural recording. The specific values for the $\widehat{ILD}$ and $\widehat{IPD}$ that are stored in the mapping table can be generated by an analytic spherical head model and/or by previously measured head-related transfer functions. The measurement of the head-related transfer functions can be achieved on a dummy head and/or on the head of the recordist and/or listener. This opens up the possibility to adapt the mapping table to the specific head and/or ear form of the listener or recordist. Especially the form of the outer ear (pinna) are important and influence the perception of sound. Therefore, if the information in the mapping table is specifically adapted for a listener or recordist, the listening experience is greatly improved. It is also possible to adapt the mapping table to an environment of the listener or recordist, achieving a more realistic listening experience.

The present invention also provides a hearing system configured to perform the aforementioned methods, comprising a hearing device and/or recording device and a head motion tracking device configured to determining a head orientation and/or a change of the head orientation of the listener and/or recordist. The hearing device can be any kind of hearing device suitable for listening to a binaural recording. For example hearing devices are loudspeakers applying crosstalk cancellation filters, headphones, earphones, in-ear or on-ear phones. The recording device can be any kind of recording device that can record different sound signals near and/or at the right and left ear of the recordist. The recordist can be a person or a dummy head to which a recording device is attached, or a jecklin disc with two microphones. For example the recording devices are in-ear or on-ear microphones. Alternatively the recording device is part of a camera mounted on the dummy head or the recording device consists of two microphones on each side of a jecklin disc.

The hearing system also comprises a head motion tracking device. For example this can be a 6-degree of freedom electromagnetic tracking system, a consumer virtual reality headset or a tracking device based on inertial measurement units. It is also possible to use a optical head motion tracking device, for example a camera or a set of cameras. Some of them determine absolute positions, from which the orientation of the head can be calculated, while other determine the orientation of the head. It is also possible that the head motion tracking device is a acoustic head-tracking device.

The acoustic head tracking device consists of a head mounted microphone array having several microphones. Preferably the array has four microphones that are positioned to be on the vertices of a tetrahedron. The acoustic head tracking device tracks the motion of the head in the acoustic domain, meaning it uses differences in the acoustic signals received by the microphones to determine the heads orientation. The differences in the acoustic signals can be a time delay between the different signals of the microphones. Together with information about the geometry of the microphone array, the source position of the acoustic signal and the head orientation can be determined.

According to a preferred embodiment of the invention the hearing device and/or recording device is configured to be worn by a listener and/or recordist. The hearing device can be any kind of hearing device that can be worn by a listener, and can provide different sound signals for the right ear and for the left ear of the listener. For example hearing devices are headphones, earphones, in-ear or on-ear phones. Examples for recording devices are in-ear or on-ear microphones. It is also possible that the recording device and the hearing device are integrated in the same device. Furthermore, it is possible that the recordist and the listener are the same person.

According to a preferred embodiment of the invention the hearing system comprises a storage device for storing a mapping table relating the head orientation to a difference between the left binaural ear signal and the right binaural ear signal for a given source direction. There are two steps in the aforementioned methods that can involve consulting the mapping table. The information stored in the mapping table about the $\widehat{ILD}$ and $\widehat{IPD}$ can be used for the determination of the source direction and for the adaptation of the binaural recording. Therefore, the hearing system comprises a storage device for storing this mapping table. It is also possible that several different mapping tables are stored. The different mapping tables can be specific to the listener and/or recordist, using the hearing system. Alternatively or additionally the different mapping tables can be specific for different environments in which binaural recordings are recorded and/or listened to. It is also possible that the mapping table is stored on a server and the hearing system is connected to that server via wireless communication technology.

These and other aspects of the invention will be apparent from and elucidated with reference to the embodiments described hereinafter. Individual features disclosed in the embodiments can constitute alone or in combination an aspect of the present invention. Features of the different embodiments can be carried over from one embodiment to another embodiment.

Figure 2:
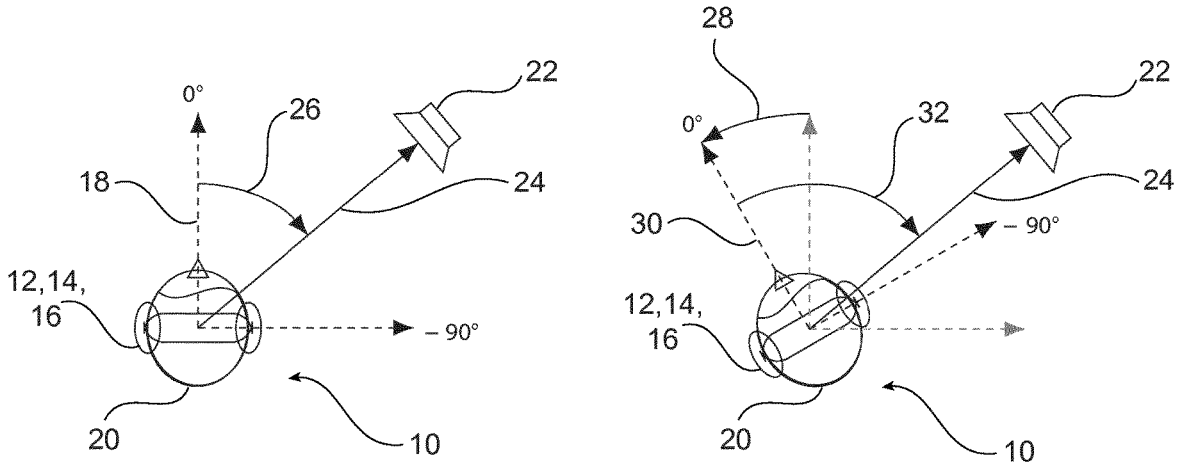
Figure 3:
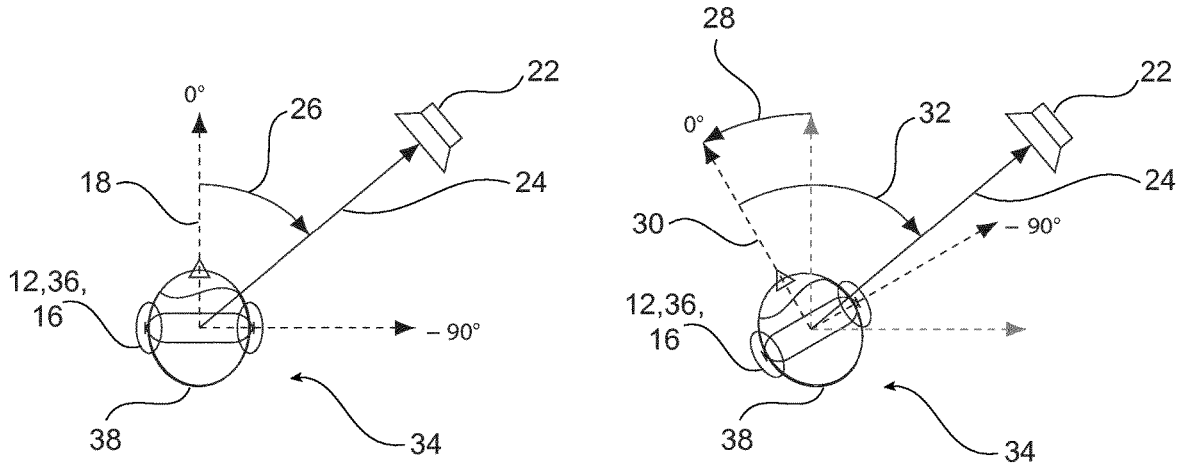
Figure 4:
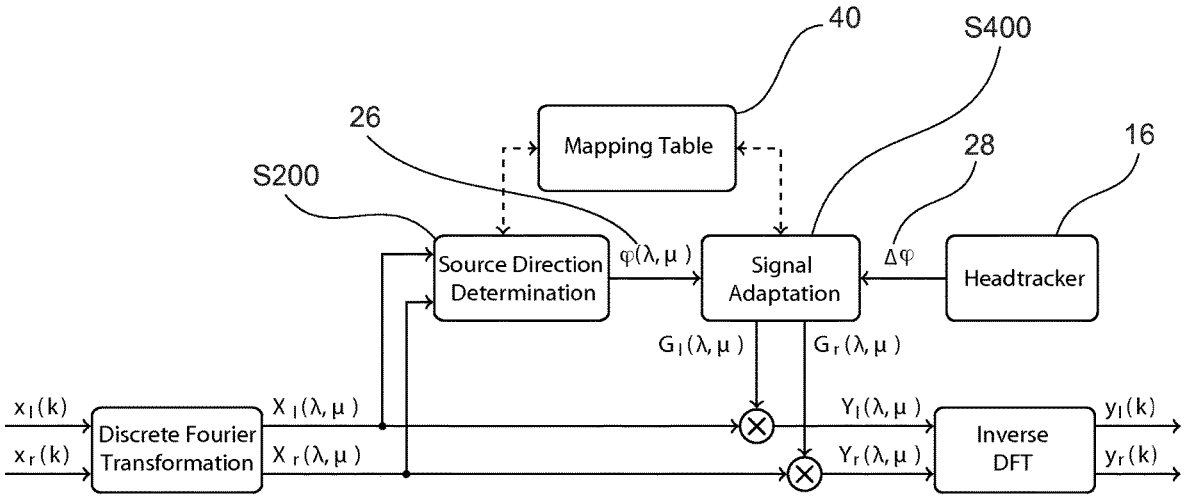
Figure 5:
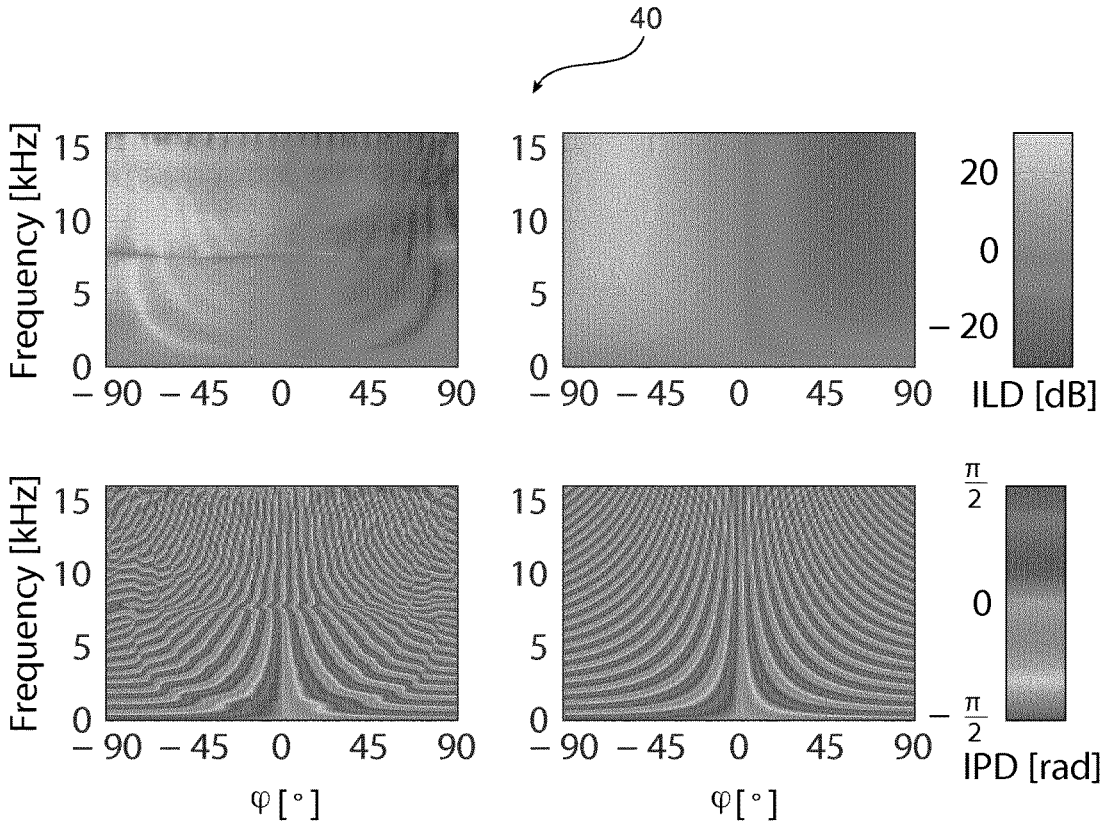

In the drawings:

FIG. 1 shows a flowchart of the steps of the methods, according to a preferred embodiment of the invention, FIG. 2 shows a recordist with a recording device, recording a binaural recording having two different head orientations, according to a preferred embodiment of the invention, FIG. 3 shows a listener with a hearing device, listening to a binaural recording having two different head orientations, according to a preferred embodiment of the invention, FIG. 4 shows a functional diagram of the methods, according to a preferred embodiment of the invention, and FIG. 5 shows an illustration of two different mapping tables, according to a preferred embodiment of the invention.

FIG. 1 shows a flowchart of the steps of the method for providing a binaural recording to a listener applied in a hearing system, according to a preferred embodiment of the invention. Furthermore, FIG. 1 shows the steps of the method for recording a binaural recording applied in a hearing system, according to a preferred embodiment of the invention. The steps of the two methods are the same, independent of an incorporation in the process of listening to a binaural recording, or of an incorporation in the process of recording a binaural recording.

FIG. 2 shows a recordist 10 with a hearing system 12, according to a preferred embodiment of the invention. The hearing system 12 comprises of a recording device 14, in this embodiment of the invention a headset with two in-ear microphones. Incorporated into the headset is a head tracking device 16, being configured to determine a orientation 18 of the head 20 of the recordist 10. The recordist 10 is in the process of recording a binaural recording of the sound, that is emitted by a sound source 22 with the hearing system 12. The recordist 10 in FIG. 2 has two different orientations of the head 20.

Hereinafter, the individual steps of the method for recording a binaural recording are briefly described with reference to the flowchart in FIG. 1, and the recordist 10 in FIG. 2.

The first step of the method, S100, is to determine the orientation 18 of the head 20 of the recordist 10. This orientation 18 of the head 20 of the recordist 10 is shown on the left side of FIG. 2. In this preferred embodiment of the invention the orientation 18 defines an origin of a reference frame and is therefore zero degrees.

In a next step of the method, S200, a source direction 24 of the binaural recording is determined with respect to the head orientation 18 of the recordist 10. The source direction 24 is a direction towards the sound source 22. It is determined without any knowledge of the environment of the recordist 10, but by analyzing the binaural recoding. After this step, the angle 26 between the orientation 18 of the head 20 of the recordist 10 and the source direction 24 is known.

In a further step of the method, S300, a change of head orientation 28 is detected. This change of head orientation 28 leads to a new orientation 30 of the head 20 of the recordist 10. This new orientation 30 of the head 20 of the recordist 10 is shown on the right side of FIG. 2.

In the final step of the method, S400, the binaural recording is adapted, considering the source direction 24 of the binaural recording and the new head orientation 30. Therefore, this step involves determining the angle 32 between the new head orientation 30 and the source direction 24.

FIG. 3 shows a listener 34 with a hearing system 12, according to another preferred embodiment of the invention. The hearing system 12 comprises of a hearing device 36, in this embodiment of the invention a headset. Incorporated into the headset is a head tracking device 16, being configured to determine a orientation 18 of the head 38 of the listener 34. The listener 34 is in the process of listening to a binaural recording. The listener 34 in FIG. 3 has two different orientations of the head 38.

Hereinafter, the individual steps of the method for providing a binaural recording to a listener 34 are described with reference to the flowchart in FIG. 1, the listener 34 in FIG. 3, the functional diagram in FIG. 4 and the mapping table in FIG. 5.

After having determined the orientation 18 of the head 38 of the listener 34 in the first step of the method S100, and shown on the left side of FIG. 3, in the next step S200 the a source direction 24 of the binaural recording is determined with respect to the head orientation 18 of the listener 34. The source direction 24 is a direction towards the perceived sound source 22. It is determined by analyzing the binaural recoding.

Referring to FIG. 4, for the purpose of analyzing the binaural recoding, the time domain signal $x_l(k)$ intended for the left ear of the listener 34 and the time domain signal $x_r(k)$ intended for the right ear of the listener 34 of the binaural recording are first transformed into a frequency domain signal by a discrete Fourier transformation (DFT). The signals in the frequency domain are denoted $X_r(\lambda, \mu)$ and $X_l(\lambda, \mu)$.

The analysis involves determining an interaural level difference (ILD) and an interaural phase difference (IPD) of the binaural recording:

$$ILD(\lambda, \mu) = \left|\frac{X_r(\lambda, \mu)}{X_1(\lambda, \mu)}\right|$$

-continued $$IPD(\lambda, \mu) = \arg\left(\frac{X_r(\lambda, \mu)}{X_1(\lambda, \mu)}\right) = \phi_r(\lambda, \mu) - \phi_1(\lambda, \mu),$$

where $X_{r,l}(\lambda, \mu)$ denotes the binaural ear signal, in a frequency bin μ, at a time instance A.

The ILD(λ,μ) and IPD(λ, μ) can be compared to $\widehat{ILD}$ and $\widehat{IPD}$ in a mapping table 40.

Referring to FIG. 5, the mapping table 40 creates a link between the head orientation 18, 30 and the difference in amplitude ($\widehat{ILD}$) and the difference in phase ($\widehat{IPD}$). The specific values for the $\widehat{ILD}$ and $\widehat{IPD}$ that are stored in the mapping table 40 can be generated by an analytic spherical head model and/or by previously measured head-related transfer functions (HRTFs). The HRTFs describe the modification of the signal by the head 38 and/or ears of the listener 34, depending on the direction of sound incidence:

$$X_l(\lambda,\mu)=H_l(\lambda,\mu)\cdot S(\lambda,\mu)$$

$$X_r(\lambda,\mu)=H_r(\lambda,\mu)\cdot S(\lambda,\mu),$$

where $H_i(\lambda,\mu)$ with $i\in\{l, r\}$ represent the HRTFs for the left and right ear, which can be divided into magnitude and phase components as:

$$H_i(\lambda,\mu)=|H_i(\lambda,\mu)\cdot e^{i\varphi_i(\lambda,\mu)},$$

The mapping table 40 contains the information of measured and or analytically calculated HRTFs, as a function of φ, the angle between the orientation 18, 30 of the head and the source direction 24:

$$\widehat{ILD}(\mu, \varphi) = \frac{|\hat{H}_r(\mu, \varphi)|}{|\hat{H}_1(\mu, \varphi)|}$$

$$\widehat{IPD}(\mu, \varphi) = \arg\left(\frac{\hat{H}_r(\mu, \varphi)}{\hat{H}_1(\mu, \varphi)}\right) = \hat{\phi}_r(\mu, \varphi) - \hat{\phi}_1(\mu, \varphi)$$

Not only the resulting $\widehat{ILD}$ and $\widehat{IPD}$ can be stored in the mapping table 40, but also the HRTFs as well.

FIG. 5 shows two examples of mapping tables 40. On the left are the $\widehat{ILD}$ (top) and $\widehat{IPD}$ (bottom) determined from measured HRTFs. On the right are the $\widehat{ILD}$ (top) and $\widehat{IPD}$ (bottom) determined from an analytic model.

The determination of the source direction 24, S200, involves a minimization approach, where the $\widehat{ILD}$ and $\widehat{IPD}$ in the mapping table 40 are determined that best fit the ILD and IPD of the binaural recording. Particularly the minimization has the following form:

$$\varphi_{orig}(\lambda, \mu) = \underset{\varphi}{\operatorname{argmin}} \frac{\widehat{ILD}(\mu, \varphi)}{ILD(\lambda, \mu)} + \frac{ILD(\lambda, \mu)}{\widehat{ILD}(\mu, \varphi)} - 2\cos(IPD(\lambda, \mu) - IPD(\mu, \varphi)),$$

where $\varphi_{orig}$ corresponds to the angle 26 between the orientation 18 of the head 38 of the listener 34 and the source direction 24.

In a further step of the method, S300, a change of head orientation 28 to a new orientation 30 of the head 38 of the listener 34 is detected. Therefore, the angle 32 between the new head orientation 30 and the source direction 24 is known. This new orientation 30 of the head 38 of the listener 34 is shown on the right side of FIG. 3.

In the final step of the method, S400, the binaural recording is adapted, considering the source direction 24 of the binaural recording and the new head orientation 30. Thereby, also the mapping table 40 is consulted. The binaural recoding is modified as follows:

$$Y_i(\lambda,\mu)=X_i(\lambda,\mu)\cdot G_i(\lambda,\mu),$$

where $G_i(\lambda, \mu)$ are complex coefficients which manipulate the ILD and IPD of the binaural recording $X_i(\lambda, \mu)$ according to $$G_i(\lambda,\mu)=G_i^{ILD}(\lambda,\mu)\cdot G_i^{IPD}(\lambda,\mu)$$

The phase modifications are $$G_r^{IPD}(\lambda, \mu) = e^{-i\frac{\Delta IPD(\lambda,\mu)}{2}}$$

$$G_1^{IPD}(\lambda, \mu) = e^{i\frac{\Delta IPD(\lambda,\mu)}{2}},$$

whereas the value of ΔIPD(λ, μ) is determined by consulting the mapping table 40:

$$\Delta IPD(\lambda,\mu)= \widehat{IPD}(\mu,\varphi_{dest}(\lambda,\mu))- \widehat{IPD}(\mu,\varphi_{orig}(\lambda,\mu)).$$

$\varphi_{dest}$ denotes the angle 32 between the new head orientation 30 and the source direction 24, which was determined in the previous step of the method (S300).

The magnitude of the complex coefficient modifies the ILDs of the binaural recording and is obtained directly from the HRTFs in the mapping table according to $$G_i^{ILD}(\lambda, \mu) = \frac{|\hat{H}_i(\mu, \varphi_{dest}(\lambda, \mu))|}{|\hat{H}_i(\mu, \varphi_{orig}(\lambda, \mu))|}.$$

The modifications get less invasive for smaller values of Δφ and the signal is not modified at all for Δφ=0.

After adapting the binaural signal, the modified signal $Y_i(\lambda, \mu)$ is transformed back to the time domain by applying a inverse Discrete Fourier Transformation (IDFT).

REFERENCE SIGNS

10 Recordist
12 Hearing system
14 Recording device
16 Head tracking device
18 Orienation of head
20 Head of recordist
22 Sound source
24 Source direction
26 Angle between head orientation and source direction
28 Change of head orientation
30 New head orientation
32 Angle between new head orientation and source direction
34 Listener
36 Hearing device
38 Head of listener
40 Mapping table

The invention claimed is:

1. A method for providing a binaural recording to a listener with a head applied in a hearing system, whereas the binaural recording is listened to using a hearing device and whereas the binaural recording consists of a left binaural ear signal intended for a left ear of the listener, and a right binaural ear signal intended for a right ear of the listener, the method comprising:

providing a binaural recording consisting of the left binaural ear signal and the right binaural ear signal to the hearing system, determining a head orientation of the listener, determining a source direction of the provided binaural recording with respect to the head orientation, detecting a change of the head orientation to a new head orientation, and adapting the provided binaural recording based on a relationship between the head orientation and the difference between the left binaural ear signal and the right binaural ear signal for a given source direction.

2. A method for recording a binaural recording applied in a hearing system, whereas the binaural recording is recorded using a recording device carried on a head of a recordist, and whereas the binaural recording consists of a left binaural ear signal received by the recording device near and/or at a left ear of the recordist, and a right binaural ear signal received by the recording device near and/or at a right ear of the recordist, the method comprising:

recording the binaural recording consisting of the left binaural ear signal and the right binaural ear signal by the recording device, determining a head orientation of the recordist, determining a source direction of the recorded binaural recording with respect to the head orientation, detecting a change of the head orientation to a new head orientation, and adapting the recorded binaural recording based on a relationship between the head orientation and the difference between the left binaural ear signal and the right binaural ear signal for a given source direction.

3. The method according to claim 1, wherein the step of detecting a change of the head orientation to a new head orientation comprises detecting a rotational movement of the head.

4. The method according to claim 1, wherein the step of determining a source direction of the binaural recording with respect to the head orientation, and the step of adapting the binaural recording considering the source direction of the binaural recording and the new head orientation, comprise consulting a mapping table relating the head orientation to a difference between the left binaural ear signal and the right binaural ear signal for a given source direction.

5. The method according to claim 1, wherein the step of determining a source direction of the binaural recording with respect to the head orientation comprises determining a difference between the left binaural ear signal and the right binaural ear signal and comparing this difference to a mapping table relating the head orientation to the difference between the left binaural ear signal and the right binaural ear signal for a given source direction.

6. The method according to claim 1, wherein the step of adapting the binaural recording considering the source direction of the binaural recording and the new head orientation comprises determining the new head orientation with respect to the source direction of the binaural recording and comparing this value of head orientation to a mapping table relating the head orientation to the difference between the left binaural ear signal and the right binaural ear signal for a given source direction.

7. The method according to claim 4, wherein the mapping table relating the head orientation to the difference between the left binaural ear signal and the right binaural ear signal for a given source direction relates the head orientation to the difference in amplitude and/or to the difference in phase between the left binaural ear signal and the right binaural ear signal for a range of frequencies of the right and left binaural ear signals and for a given source direction.

8. The method according to claim 4, wherein the mapping table relating the head orientation to the difference between the left binaural ear signal and the right binaural ear signal for a given source direction is adaptable to the head of the listener and/or to the ears of the listener and/or to an environment of the listener.

9. A method for providing a binaural recording to a listener, whereas the binaural recording is recorded using a recording device carried on a head of a recordist, and whereas the binaural recording consists of a left binaural ear signal received by the recording device near and/or at a left ear of the recordist, and a right binaural ear signal received by the recording device near and/or at a right ear of the recordist, the method comprising:

providing a binaural recording consisting of the left binaural ear signal and the right binaural ear signal to the hearing system, determining a head orientation of the listener, determining a source direction of the provided binaural recording with respect to the head orientation, detecting a change of the head orientation to a new head orientation, adapting the provided binaural recording considering the determined source direction of the binaural recording and the detected new head orientation, and wherein the binaural recording is provided to the listener by a method according to claim 1.

10. A hearing system configured to perform the method according to claim 1, comprising a hearing device and/or recording device and a head motion tracking device configured to determine a head orientation and/or a change of the head orientation of the listener and/or recordist.

11. The hearing system according to claim 10, wherein the hearing device and/or recording device is configured to be worn by a listener.

12. The hearing system according to claim 10, wherein the hearing system comprises a storage device for storing a mapping table relating the head orientation to a difference between the left binaural ear signal and the right binaural ear signal for a given source direction.

13. A hearing system configured to perform the method according to claim 2, comprising a hearing device and/or recording device and a head motion tracking device configured to determine a head orientation and/or a change of the head orientation of the listener and/or recordist.

* * * * *